US006955396B2

(12) United States Patent
Moon et al.

(10) Patent No.: US 6,955,396 B2
(45) Date of Patent: Oct. 18, 2005

(54) SELF STABILIZING AND SHOCK ABSORBING FOLDING PICNIC TABLE SUPPORT STRUCTURE

(75) Inventors: Brian Moon, Dekalb, IL (US); Michael Uffner, Naperville, IL (US)

(73) Assignee: Suncast Corporation, Batavia, IL (US)

( * ) Notice: Subject to any disclaimer, the term of this patent is extended or adjusted under 35 U.S.C. 154(b) by 0 days.

(21) Appl. No.: 10/397,978

(22) Filed: Mar. 26, 2003

(65) Prior Publication Data

US 2004/0189060 A1 Sep. 30, 2004

(51) Int. Cl.[7] ..... A47B 3/14
(52) U.S. Cl. ..... 297/158.4; 108/132
(58) Field of Search ..... 297/158.4, 158.3; 108/132; 248/188

(56) References Cited

U.S. PATENT DOCUMENTS 390,173 A * 9/1888 Jones ..... 108/132
1,859,588 A * 5/1932 Kehrer ..... 108/132
2,568,622 A * 9/1951 Hagan ..... 297/158.4
2,849,053 A * 8/1958 Beller et al. ..... 297/158.4
3,273,936 A * 9/1966 Deavers ..... 297/158.4
3,574,393 A 4/1971 Hughes
3,979,884 A 9/1976 Russell
4,074,636 A * 2/1978 Wilson ..... 108/175
4,330,151 A 5/1982 Healey
5,921,623 A 7/1999 Nye et al.
6,142,560 A * 11/2000 Miller ..... 297/158.4
6,347,831 B1 2/2002 Nye et al.

* cited by examiner

*Primary Examiner*—Peter M. Cuomo
*Assistant Examiner*—Joe Edell
(74) *Attorney, Agent, or Firm*—McHale & Slavin, P.A.

(57) ABSTRACT

A self stabilizing and shock absorbing support structure for a collapsible picnic table having integral benches. The support structure includes U-shaped members resiliently attached to each other in a coplanar arrangement which allows the supports to flex and stabilize independently. This arrangement also allows the support structure to absorb shock which would normally be transferred across the table from one bench seat to the other.

14 Claims, 11 Drawing Sheets

SELF STABILIZING AND SHOCK ABSORBING FOLDING PICNIC TABLE SUPPORT STRUCTURE

FIELD OF THE INVENTION

This invention relates generally to the field of foldable tables, and more particularly to an independently stabilizing and shock absorbing support structure for folding picnic tables.

BACKGROUND OF THE INVENTION

Conventional picnic tables are typically a single unit which includes a fixed table partially surrounded by a fixed seating area. Conventional picnic tables are generally large heavy fixtures that are kept outdoors on a continuous basis. Alternatively, picnic tables can be made relatively lightweight and portable, allowing them to be set up and then removed as needed. For example, at a large gathering, whether indoors or outdoors, it may necessary to provide temporary table seating arrangements. In this case, it would be highly advantageous to provide lightweight, compact and easily storable table and chair units.

Portable picnic tables in the form of an elongated rectangular tabletop with longitudinally aligning bench seats are sometimes constructed as unitary, foldable items which collapse into a convenient storage form. The legs of such picnic tables collapse from an extended, freestanding, position into a storage, or collapsed, condition. A major distinction with folding picnic tables is that a pair of seats are integrated with the table into a single unit. As the picnic tables collapse, the table and seats move into a coplanar relationship of relatively narrow profile, facilitating transportation and storage. Representative examples of this type of collapsible picnic table include U.S. Pat. Nos. 3,574,393, 3,979,884, 5,921,623, and 6,347,831. Each of these prior art tables have inwardly folding support structures which enable the table to be collapsed flat for storage.

Portable folding picnic tables, as represented by the the prior art generally utilize two one piece metal supports located at opposing ends of the table to which the table and both benches foldably attach. The one piece metal supports have resulted in a number of stability and comfort problems for consumers using folding tables with this construction. The lightweight table structure in combination with the one piece metal supports, create instability when weight is transferred from one side of the table to the other, resulting in lifting and/or tipping especially when only one bench seat is utilized. In addition, by virtue of the solid common structural element shock is transferred from one bench seat to the other when a person sits on the opposite side, jarring those already sitting at the table. Both of these shortcomings affect the comfort of those using these devices.

An example of a foldable picnic table is seen in Nye, U.S. Pat. No. 6,347,831, which discloses a collapsible rectangular picnic table with benches attached to a one piece metal support. The benches are constructed to be raised to the level of the tabletop to provide what is described as a platform or stage. The design of the metal support places the center of gravity of those sitting at the table outside of the metal support allowing the lightweight table to be easily tipped over, especially when only one bench is utilized. Furthermore, the one piece support which connects both benches creates a lever arm which tends to lift the more lightly loaded side, causing instability and discomfort.

Healey, U.S. Pat. No. 4,330,151, discloses a rectangular picnic table which also utilizes a one piece metal support.

The benches are moved to a fixed inward position toward the table in the '151 patent to decrease the tipping tendencies of the table when only one bench is utilized. However, the vertical alignment of the front edge of the bench with the edge of the table in this design positions the benches too close to the table for comfortable seating. In addition, the benches are fixed rigidly onto the one piece support frame of the table allowing shock and vibration to transfer across the table from one bench seat to the other. Still further, this support structure does not fold or collapse into a conveniently storable unit.

Accordingly, what is lacking in the prior art is support structure for a collapsible picnic table constructed with a plurality of independently stabilizing and shock absorbing supports. The independently stabilizing support structure should provide greater pleasure and comfort for those using the table. The table should remain stable and not tip when all of the people on one side of the table leave or sit down at the same time. The table should also remain stable when the side to side weight of the users is not in balance or the table is placed on an uneven surface. The independent support arrangement should also reduce the shock transferred across the table when a user sits down on the opposite bench seat.

SUMMARY OF THE INVENTION

It is an objective of the invention to provide a self stabilizing support structure for collapsible picnic tables.

It is another objective of the invention to provide a shock absorbing support structure for collapsible picnic tables.

It is still another objective of the invention to provide a support structure for a collapsible picnic table having independent support legs which are connected with a resilient member to allow each side of the table to flex and stabilize independently from the other.

It is a further objective to provide a stabilizing and shock absorbing support structure for a collapsible picnic table having integral benches which can be folded into a compact state for shipment or storage without sacrificing any of its stability and strength.

In accordance with the above objectives, a stabilizing and shock absorbing support structure for a collapsible picnic table having integral benches is provided. The support structure includes telescoping bench seat supports which allow the benches to be raised into a position aligning with the table top to create an extra-wide tabletop surface and lowered to a position to provide seating.

A picnic table generally comprises a table panel with a top surface, a bottom surface, two opposed ends and two opposed sides, a first bench seat located contiguous with one of the opposed sides and a second bench seat located contiguous with the other opposed side. The first and second bench seats have a top surface and a bottom surface, and a first and second end. The self-stabilizing and shock absorbing support structure for the table panel and the bench seats includes two pairs of like-constructed U-shaped foldable leg members resiliently connected to each other forming two support assemblies each supported by a track guided brace assembly. The four U-shaped support members each include a wide base section, a first rigid upright leg and a second telescoping upright leg. Each of the support assemblies include two of the U-shaped support members having their rigid upright legs attached to each other via a resilient member in a coplanar arrangement. One support assembly is foldably attached to the bottom surface of the table panel proximate to each of the opposed ends. Each of the support assemblies include a track guided brace assembly having a first end attached to the resilient member and a second end slidably attached to the bottom surface of the table panel. The brace arrangement allows the support assemblies to be braced in an upright position while allowing them to flex independently. The two bench seat members are independently supported at opposing sides of the table panel by the telescoping upright leg of the U-shaped members and are essentially isolated from one another, whereby shock transference is minimized. The resilient member is constructed and arranged to allow the U-shaped leg members to flex independently and reduce shock normally transferred through the table. The construction also allows the table to flex slightly and stabilize on uneven surfaces or during uneven loading. The telescoping upright leg members have an adjustably telescoping construction, whereby the benches may be adjusted in height from a first upper position coplanar with the table panel to a second lower position below and outward from the table panel to provide seating. A locking means is disposed in the telescoping portion of the upright U-shaped leg members for securing the benches in contact with the table panel. The telescoping portion can comprise an inner tubular member and an outer tubular member in a nested arrangement, and the locking means can comprise a spring-biased tab mounted in the inner tubular member which engages with an aperture in the outer tubular member. When the table panel and said bench seats are disposed in the same plane, the U-shaped leg members can be pivoted until they are essentially coplanar to the table panel and benches so that the table can be stored in a flat configuration. An optional locking means may be provided for securing the benches in contact with the table panel. In a non-limiting embodiment the locking means may be disposed in the track guided brace assembly. Alternatively, the locking means may include a securing strap adapted for attachment to the lower surface of the table panel and/or bench seats for securing the U-shaped support members in place.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

It should be appreciated that while the preferred embodiment is exemplified as a picnic table with appended benches, the support structure as described herein may also be applied to a folding table without the appended benches.

Figure 1:
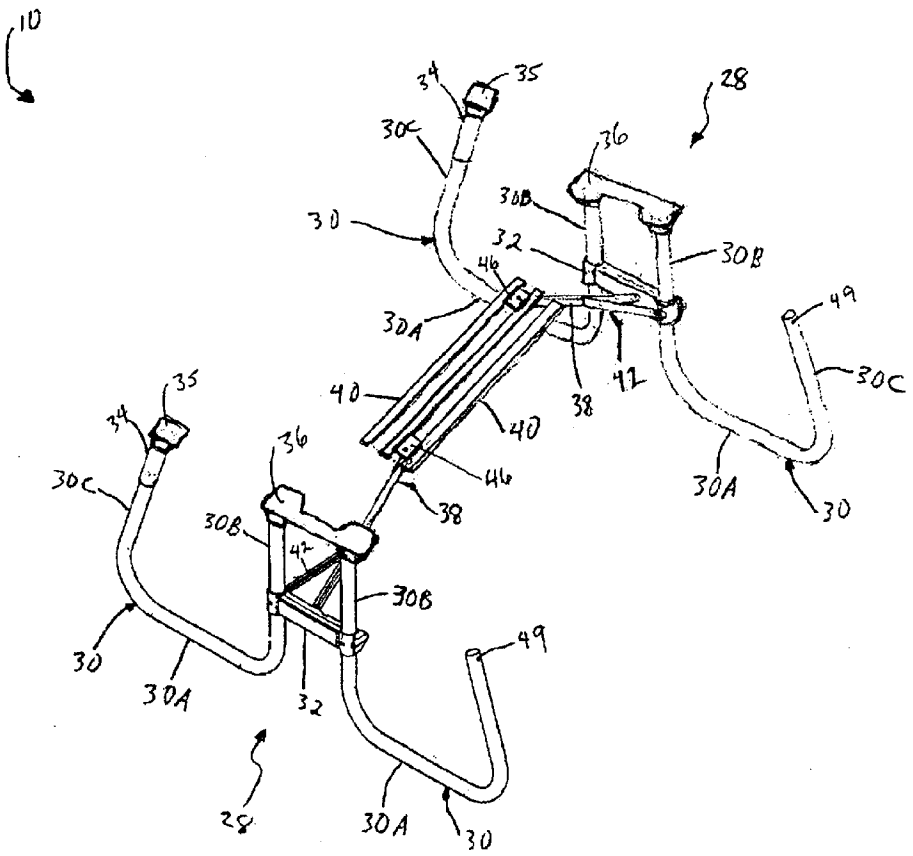
FIG. 1 is a perspective view of a preferred embodiment of the stabilizing and shock absorbing collapsible support structure of the present invention.
Figure 2:
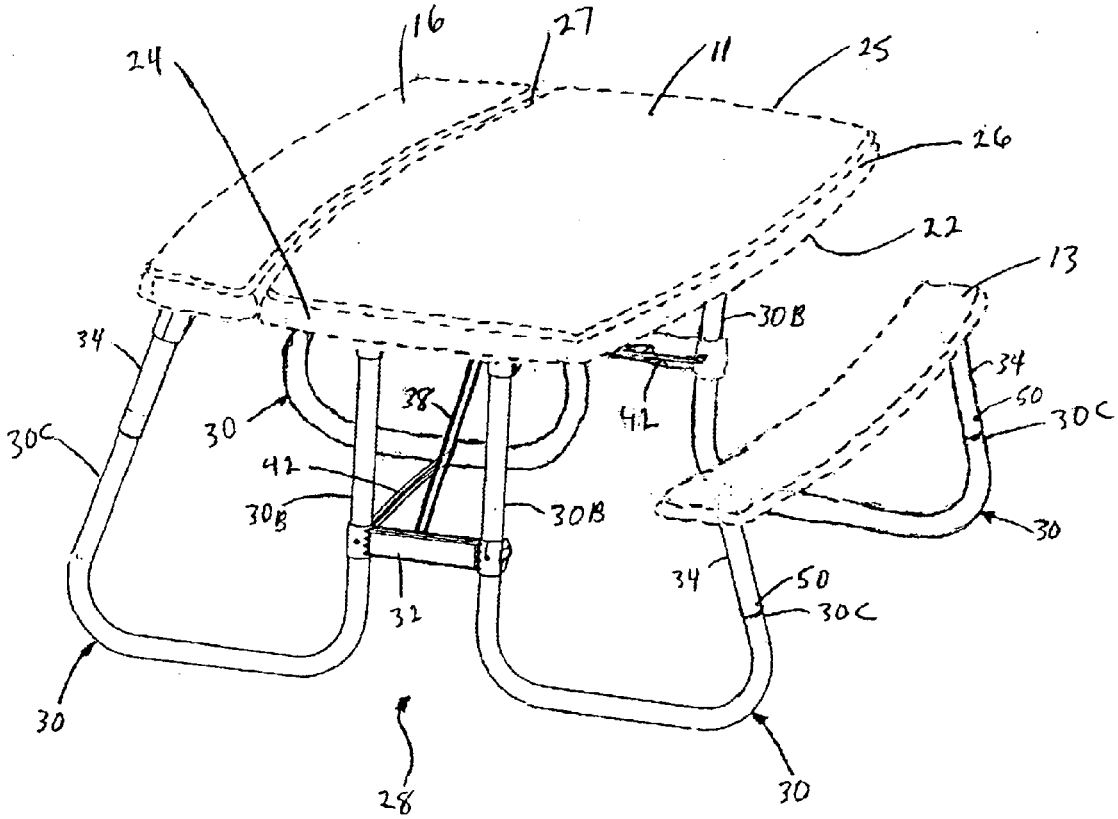
FIG. 2 is a perspective view of the stabilizing and shock absorbing collapsible support structure of FIG. 1 in which a table top and bench seats are illustrated attached to the structure.
Figure 3:
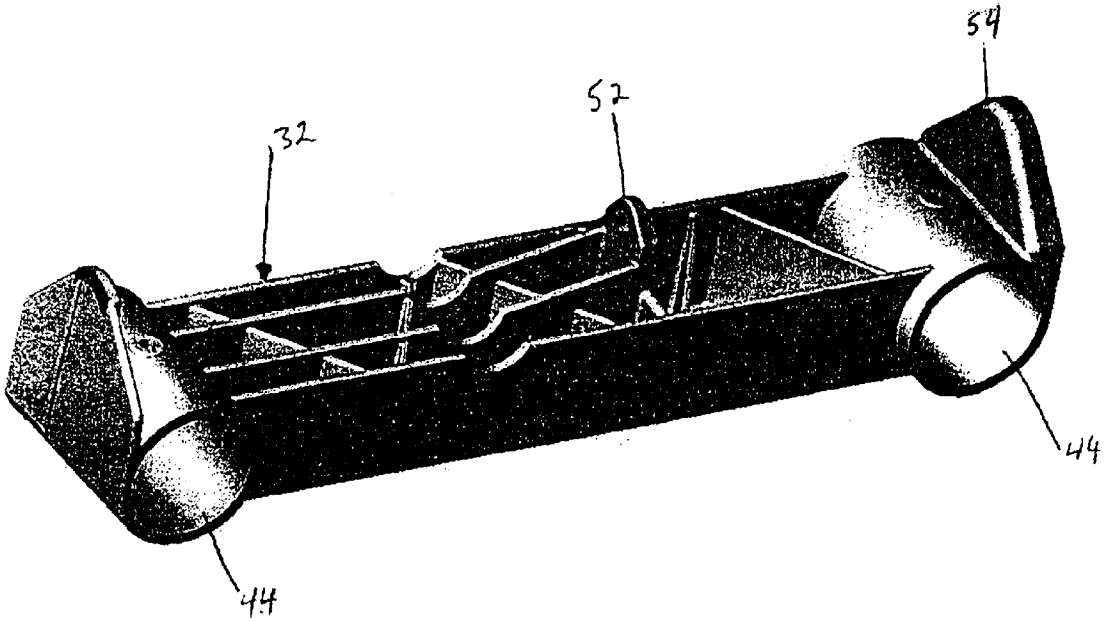
FIG. 3 is a perspective view of the resilient member.
Figure 4:
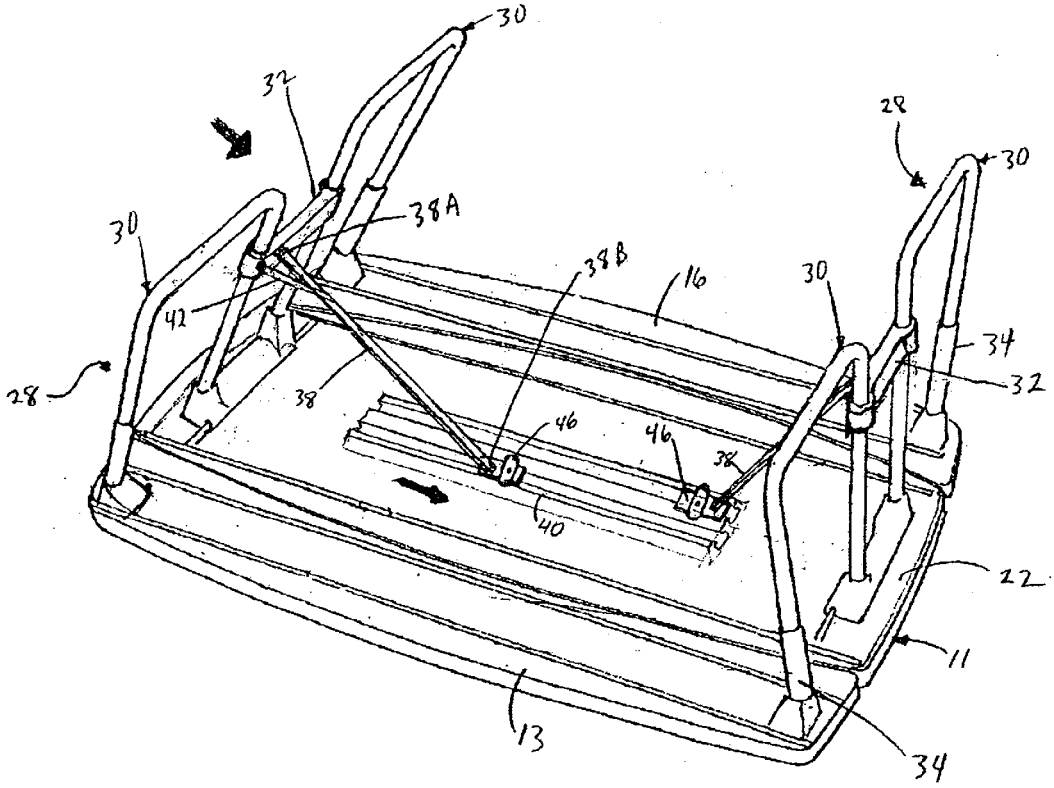
FIG. 4 is a perspective view of the bottom of the stabilizing and shock absorbing support structure illustrated with a table top and bench seats attached to the structure and showing the folding of the support assemblies inward.
Figure 5:
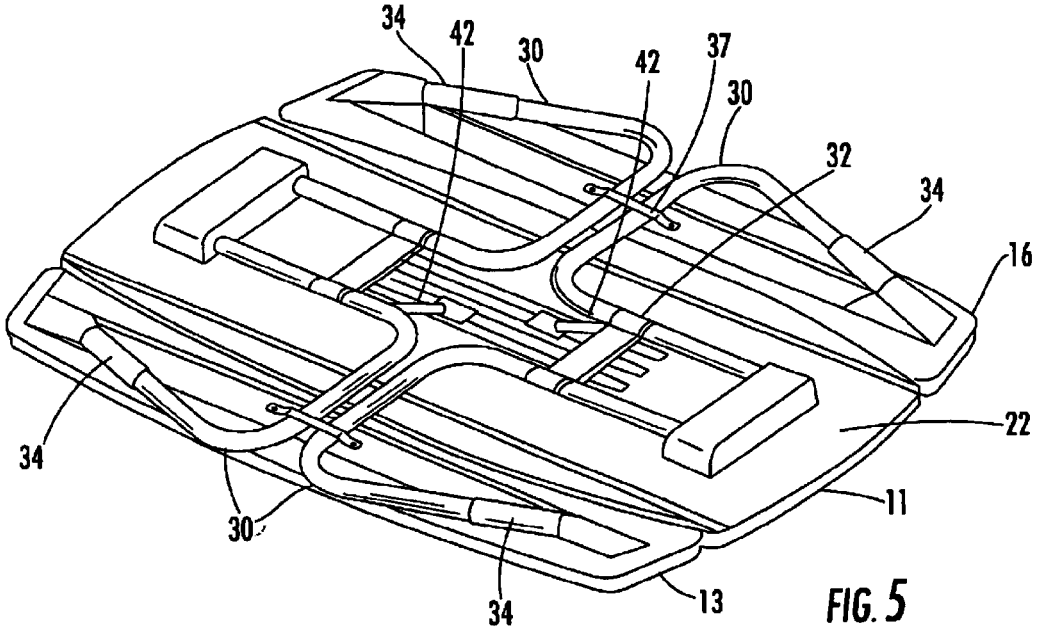
FIG. 5 is a perspective view of the bottom of the stabilizing and shock absorbing support structure of FIG. 1 illustrated with a table top and bench seats attached in which the support assemblies have been folded inward for storage.
Figure 6:
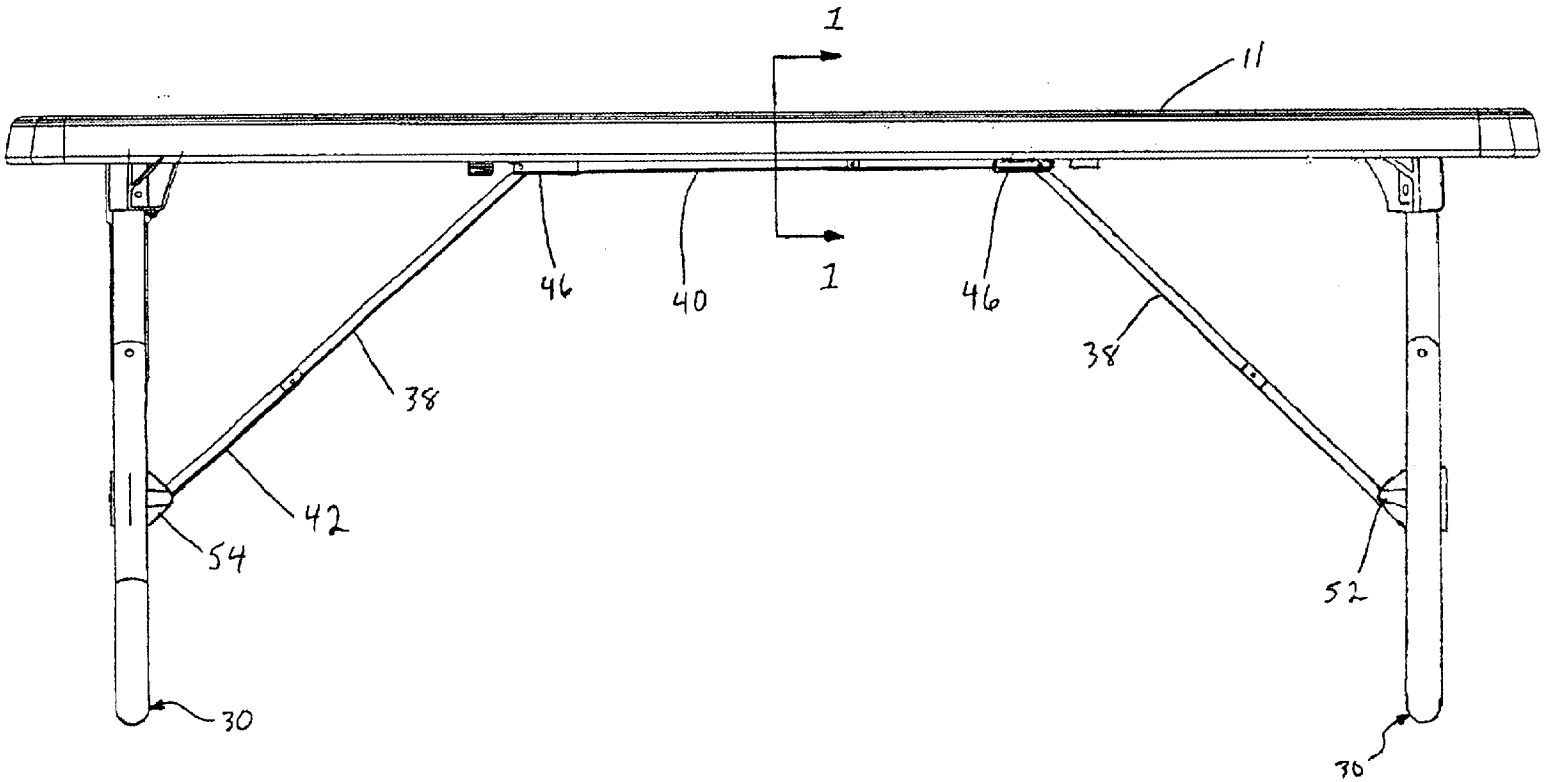
FIG. 6 is a side view of the stabilizing and shock absorbing support structure of FIG. 1 illustrated with a table top attached to the structure.
Figure 7:
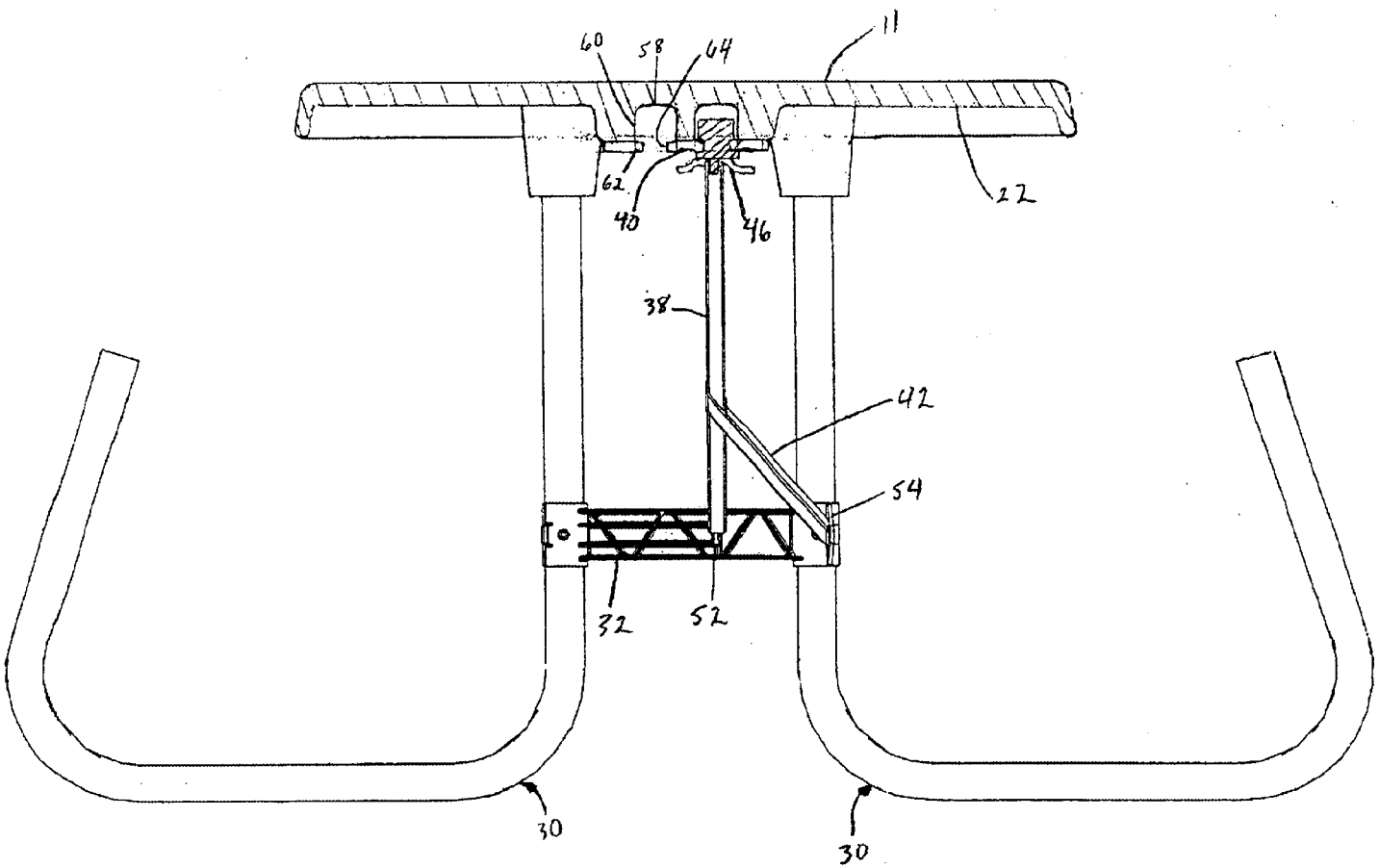
FIG. 7 is an end view sectioned along lines 1—1 of FIG. 3 illustrating the angled brace connected to the latch assembly and its cooperation with the track assembly.
Figure 8:
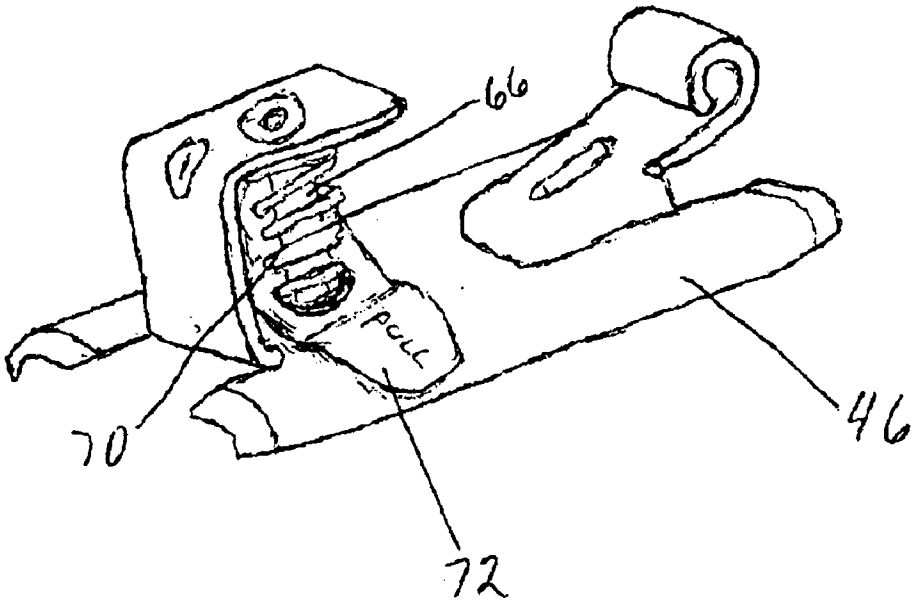
FIG. 8 is a perspective view of the latch assembly, illustrating the release lever, the biasing means and the locking pin.
Figure 9:
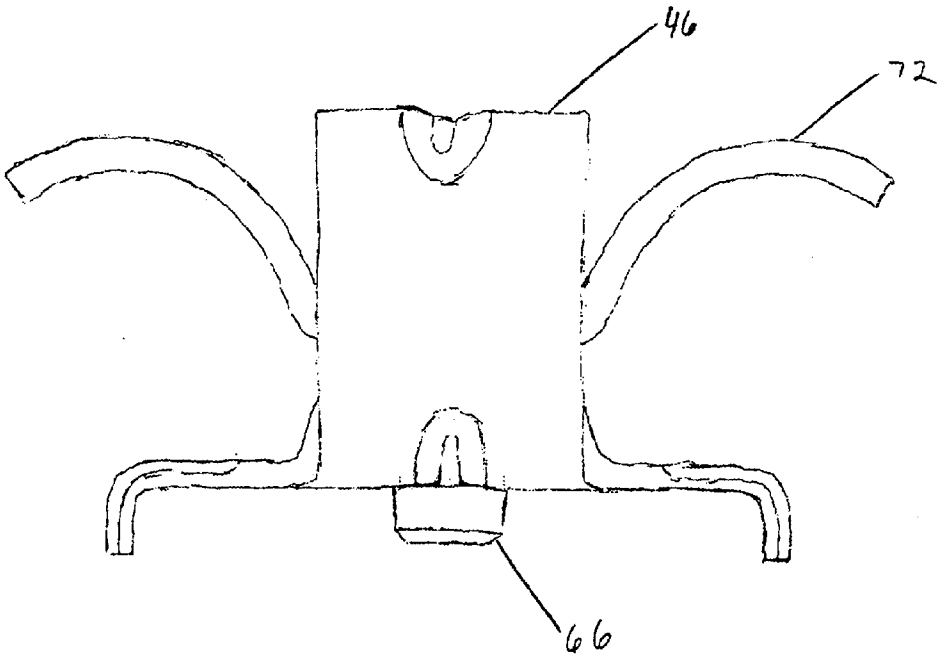
FIG. 9 is an end view of the latch assembly.
Figure 10:
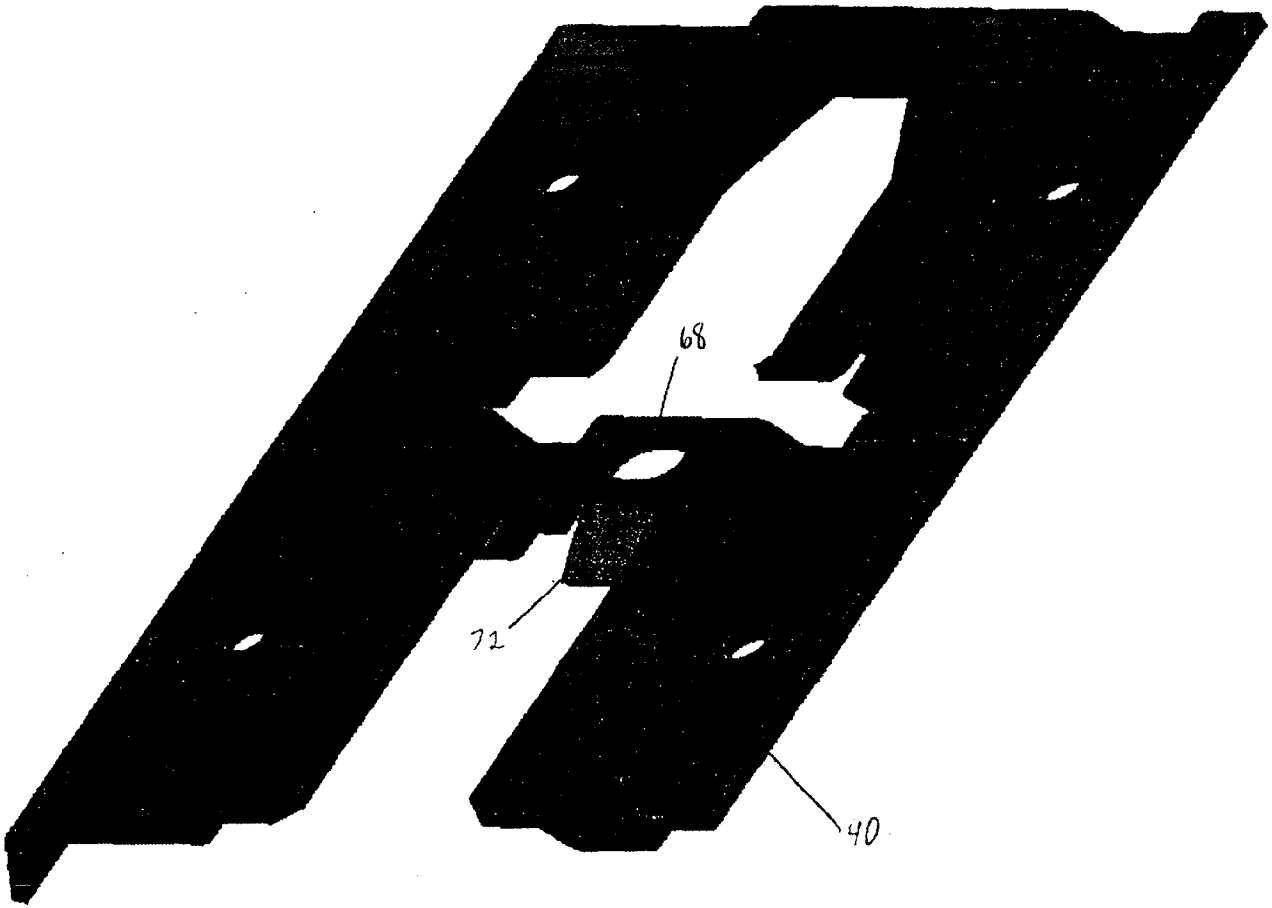
FIG. 10 is a perspective view of the locking pin receiver.
Figure 11:
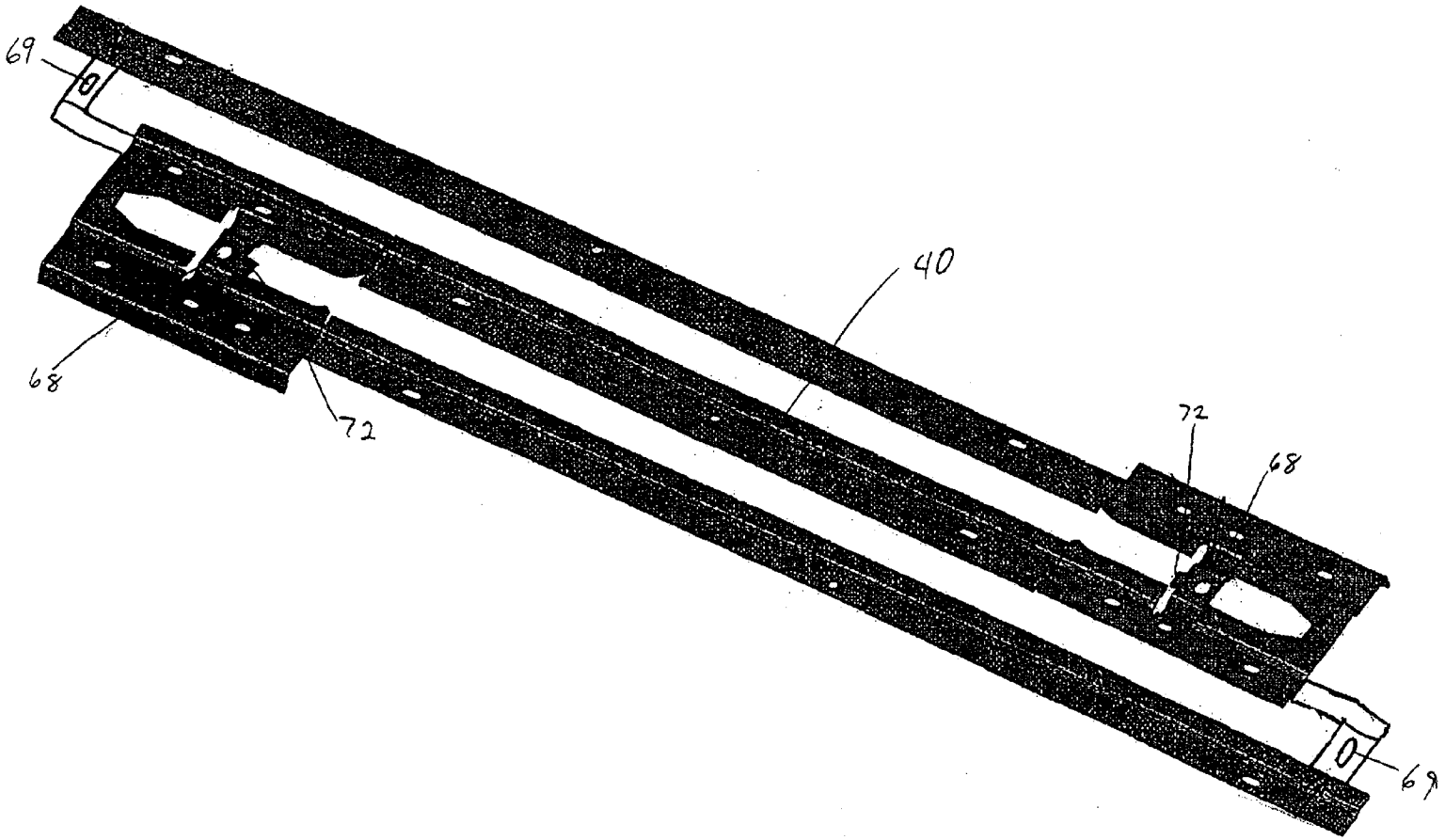
FIG. 11 is a partial perspective view of the track assembly.

A presently preferred embodiment of the self stabilizing and shock absorbing picnic table support structure 10 of the present invention is illustrated in FIGS. 1–3. The support structure 10 generally comprises four like constructed U-shaped support members 30 resiliently connected to form two self stabilizing support assemblies 28. The U-shaped support members 30 each having a wide base section 30A, a first rigid upright leg 30B, and a second telescoping upright leg 30C. The resilient member 32 includes two apertures 44 (FIG. 3) each constructed and arranged to cooperate with an upstanding leg member 30C. Each of the self stabilizing support assemblies 28 include two of the U-shaped support members 30 having their rigid upright legs 30B attached to each other via resilient member 32 in a coplanar arrangement. The support assemblies 28 are constructed and arranged to foldably attach to the bottom surface 22 of a table panel 11 proximate to each of the opposed ends 24 and 25 (FIG. 2) via a plastic member 36. The plastic member 36 is constructed and arranged to cooperate with the rigid upright leg 30B of the U-shaped members 30 to allow the support assemblies 28 to be secured to the bottom surface 22 of the table panel 11 without the need for weldments. Each of the support assemblies is provided with a track guided support brace 38 having a first end pivotally attached to the resilient member via tabs 52 and 54 and a second end attached to a latch assembly 46 which slides in a track 40 mounted to the bottom surface 22 of the table panel 11. The support assemblies 28 are also constructed and arranged to attach to the bottom surface of two bench seat members 13 and 16 which are supported at opposing sides 26 and 27 of the table panel 11 by the telescoping upright leg 30C of the U-shaped members 30. The telescoping upright legs 30C are secured to the bench seat members 13 via plastic members 35. The plastic members 35 are constructed and arranged to cooperate with each of the telescoping upright legs 30C of the U-shaped members 30 to allow the support assemblies 28 to be secured to the bottom surface of the bench seats 13 and 16 without the need for weldments. The resilient member 32 (FIG. 3) is constructed and arranged to allow the U-shaped members 30 to flex independently and dampen shock normally transferred through the table. The construction also allows the table to flex slightly and stabilize on uneven surfaces or during uneven loading. The resilient member 32 is preferably constructed of plastic but may be constructed of other suitable materials well known in the art, including but not limited to rubber, spring steel, fiberglass, phosphor bronze, aluminum, or suitable combinations thereof. The resilient member 32 of the preferred embodiment includes two mounting tabs 52 and 54 for attachment of the support brace 38 and a stabilizer brace 42. The stabilizer brace 38 attaches to the resilient member 32 proximate to one of the upright legs 30B and to the support brace 38. This arrangement allows one of the U-shaped members 30 of each of the support assemblies 28 to be more rigidly supported than the other U-shaped member 30 allowing the table to stabilize on uneven surfaces.

In the preferred embodiment the telescoping upright legs 30C of the U-shaped members 30 include an inner tubular member 30 and a outer tubular member 34 in a nested arrangement. The outer tubular member 34 is slidably disposed on inner tubular member 30 so that the height of the bench seats 13 and 16 can be selectively adjusted between an upper position coplanar to center table panel 11 to a lower position at a height suitable for seating. An optional hard plastic bushing (not shown) can be disposed between the outer tubular member 34 and inner tubular member 30 to facilitate the sliding of the inner tubular member 30 within the outer tubular member 34.

The telescoping upright leg 30C can be secured in the extended or lowered position by any suitable locking means well known in the art. In the preferred embodiment, a spring-biased tab 49 extends from inner tubular member 30 which engages with cooperating aperture 50 in outer tubular member 34. To lower a bench seat 13 and/or 16, the locking tabs 49 are manually depressed until they are unseated from the aperture 50 allowing the outer tubular member 34 to slide downward with respect to the inner tubular member 30. To raise a bench seat 13 and/or 16, the bench is pulled upward displacing the outer tubular member 34 with respect to the inner tubular member 30 until the locking tabs 49 engage apertures 50.

The telescoping legs 30C of the U-shaped members 30 are constructed and arranged to extend at an acute angle from the base section 30A. The acute angle between the base section 30A and the telescoping upright section 30C assures the center of gravity of weight applied to the bench seats 13 and 16 remains within the footprint of the support assemblies 28. This arrangement in combination with the resilient member 32 allows one side of the table to be loaded without danger of tipping the table. This arrangement also provides a large surfaced table without open gaps when the bench seats 13 and 16 are in the raised position juxtaposed to the opposing sides 26 and 27 of the table panel 11.

Referring to FIGS. 4 through 7, the bottom of the stabilizing and shock absorbing support structure 10 is illustrated with a table top 11 and bench seats 13 and 16 attached to the structure 10 showing the folding of the support assemblies 28 inward. The rigid upright legs 30B of the U-shaped members 30 are constructed and arranged to be pivotally mounted on the bottom surface of the table panel 11 while the telescoping upright members 30C are constructed and arranged to be pivotally mounted to the bottom surface of the bench seats 13 and 16. The telescoping arrangement of the upright leg member 30C allows the self stabilizing support members 28 to be folded inward to a position substantially parallel to the table panel 11 (FIG. 5) when the telescoping leg member 30C is in the extended position wherein the benches 13 and 16 are coplanar with the table panel 11. An optional strap means 37 may be secured to the bottom surface of the table panel 11 or bench seats 13 or 16 to secure the support members 28 in the folded position. The strap means 37 preferably utilizes a hook and loop arrangement for securing support members generally parallel to the bottom surface of the table panel 11. However, other suitable fastening means well known in the art may also be utilized to maintain the generally parallel arrangement. The brace assembly 38 has a first end 38A flexibly connected to the resilient member 32 via conventional attachment means, e.g. pivot pin, rivet, bolt and the like, and a second end 38B connected to a latch assembly 46 slidably mounted within a track 40 attached to the bottom surface 22 of center table panel 11. With this arrangement the brace 38 supports the shock absorbing assemblies 28 in an upright position while allowing the U-shaped members 30 to flex and twist the resilient member 32 a limited amount for shock absorbency and stability. The combination of the track 40 and the slidably mounted latch assembly 46 allows the self stabilizing assemblies 28 to be movable between a collapsed position adjacent to the table panel 11 and an upright position generally perpendicular to the table panel 11. The track 40 (FIG. 7) includes a bottom surface 58 lying generally parallel to the table panel 11, two generally vertical walls 60 extending perpendicular to the bottom surface 58 and two inwardly extending rails 62 which leave a slot 64 extending the length of the track 40.

Referring to FIGS. 8 through 11, the latch assembly 46 is constructed and arranged to slide within the track 40 and includes a locking means, illustrated herein as a spring biased pin 66, to allow the self stabilizing support members 28 to be pivoted between the parallel and perpendicular positions. The locking means is preferably spring biased to a locked position wherein the pin 66 automatically engages at least one aperture 68 (FIG. 10) at one end of the track 40 and may optionally engage a second aperture 69 at the second end of the track 40. The latch means 46 is constructed and arranged to contain a pin 66 and a pin biasing means 70. As the locking means 46 slides to either end of the track 40, a small ramp 72 forces the pin 66 against the pin biasing means 70. As the pin slides across the apertures 68 or 69 the pin is biased through the aperture 68 or 69 locking the self stabilizing assembly 28 in place. The pin 66 can be released from the aperture 68 manually by utilizing the release handle 72.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A combination of elements adapted to provide a self stabilizing and shock absorbing collapsible picnic table support structure said combination including:

a first support assembly and a second support assembly each including a first U-shaped support member having a first base section, a first rigid upright leg and a first telescoping upright leg and a second U-shaped support member having a second base section, a second rigid upright leg and a second telescoping upright leg, each said first and second telescoping upright leg having an outer tubular member and an inner tubular member slidably disposed relative to each other, said first and said second rigid upright legs of each said first and said second support assembly being resiliently attached to each other via a resilient member in wherein said resilient member extends between the first and second rigid upright legs and each resilient member includes two apertures surrounding said first and second upright legs for attachment to one another and to secure said first and second U-shaped support members in a coplanar relationship, whereby each said first and said second rigid upright leg is pivotally attached to a bottom surface of a table panel, wherein said first support assembly is pivotally attached proximate to a first opposed end of said table panel and wherein said second support assembly is pivotally attached proximate to a second opposed end of said table panel, wherein said first telescoping upright leg of said first support assembly is pivotally attached to a bottom surface of a first bench seat proximate to a first opposed end and said second telescoping upright leg of said first support assembly is pivotally attached to a bottom surfaces of a second bench seat proximate to a first opposed end, wherein said first telescoping upright leg of said second support assembly is constructed and arranged to pivotally attach to said bottom surfaces of said first bench seat proximate to a second opposed end and said second telescoping upright leg of said second support assembly is pivotally attached to said bottom surfaces of said second bench seat proximate to a second opposed end;

each said first and second support assembly including at least one support brace for providing support to said first or said second respective support assemblies while in an upright position, each said support brace having a first end pivotally attached to said resilient member and a second end slidably attached to said bottom surface of said table panel wherein each said support brace, respectively, allows said first and said second support assemblies to be pivoted between a collapsed position adjacent to said table panel and an upright position generally perpendicular to said table panel;

whereby said table support structure is constructed and arranged to flex and twist a limited amount to provide stability and shock absorbency to said picnic table and to selectively adjust the height of said first and second benches relative to said table panel.

2. The stabilizing picnic table support structure of claim 1 wherein each said resilient member includes at least one tab extending outwardly from said resilient member for attachment of a brace member.

3. The stabilizing picnic table support structure of claim 1 wherein each said resilient member is constructed from plastic.

4. The stabilizing picnic table support structure of claim 1 wherein each said resilient member is constructed from rubber.

5. The stabilizing picnic table support structure of claim 1 wherein each said resilient member is constructed from spring steel.

6. The stabilizing picnic table support structure of claim 1 wherein said at least one support brace includes a stabilizer brace having a first end and a second end, wherein said first end of said stabilizer brace attaches to said resilient member proximate to one of said rigid upright legs and said second end attaches to said support brace, whereby said stabilizer brace provides added support to proximate to one of said U-shaped support memers while allowing the other U-shaped support member of said support assembly to flex and twist to provide stability to said support structure on uneven surfaces.

7. The stabilizing picnic table support structure of claim 1 wherein each said support brace includes a latch assembly pivotally mounted to said second end of said support brace, wherein said latch assembly is slidably mounted in a track extending longitudinally along said bottom surface of said table panel;

whereby said latch assembly engages said track to lock said support assembly in a position generally perpendicular to said table panel.

8. The stabilizing picnic table support structure of claim 7 wherein said latch assembly engages said track to lock said support assembly in a position generally parallel to said table panel.

9. The stabilizing picnic table support structure of claim 8 wherein said latch assembly includes a means of biasing said pin to engage said track.

10. The stabilizing picnic table support structure of claim 7 wherein said latch assembly includes a pin for engaging said track and a release lever for disengaging said pin from said track.

11. The stabilizing picnic table support structure of claim 10 wherein said pin biasing means is a coil spring.

12. The stabilizing picnic table support structure of claim 7 including a strap means secured to said bottom surface of at least one of said bench seats, said strap means adapted for securing said support assemblies in a position generally parallel to said table panel.

13. The stabilizing picnic table support structure of claim 1 wherein said U-shaped support member telescoping upright legs extend upward at an acute angle with respect to said base section of said U-shaped support member thereby moving the center of gravity of weight applied to said bench seats inside the base perimeter of said shock absorbing picnic table.

14. The stabilizing picnic table support structure of claim 1, wherein a locking means is disposed in the telescoping portion of each said telescoping upright leg for securing said first and second benches in a first upward position coplanar with said table panel and a second lower position below and outward from said table panel.

* * * * *